United States Patent [19]

Vallieres, Jr. et al.

[11] 4,367,781

[45] Jan. 11, 1983

[54] INTERLEAVED FLEXIBLE WEATHER DOOR AND METHOD OF MANUFACTURE

[76] Inventors: Theodore E. Vallieres, Jr., 301 Porter St., Manchester, N.H. 03103; Nicholas F. Dinicola, Wire Rd., P.O. Box 393, Merrimack, N.H. 03054

[21] Appl. No.: 190,190

[22] Filed: Sep. 24, 1980

[51] Int. Cl.[3] ..... A47H 23/05

[52] U.S. Cl. ..... 160/332; 160/184

[58] Field of Search ..... 160/130, 184, 332, 196 R, 160/196 D; 493/466, 390, 136, 137, 139; 428/57; 2/243, 244

[56] References Cited

U.S. PATENT DOCUMENTS

| | | | |
|---|---|---|---|
| 3,254,698 | 6/1966 | Fox et al. | 160/332 X |
| 3,331,425 | 7/1967 | Groves et al. | 160/184 |
| 4,004,296 | 1/1977 | Kandel | 2/243 X |
| 4,095,642 | 6/1977 | McKinnon | 160/332 |
| 4,232,725 | 11/1980 | Gidge | 160/332 |
| 4,296,792 | 10/1981 | Gidge | 160/332 |

*Primary Examiner*—Price C. Faw, Jr.
*Assistant Examiner*—Cherney S. Lieberman
*Attorney, Agent, or Firm*—Thomas N. Tarrant

[57] ABSTRACT

A weather door suitable for commercial garages and warehouses made from sheets of flexible plastic having a length at least twice the height of the doorway to be covered and in which the sheet of plastic is slit in such a way so that when it is folded in the middle, a series of strips of the plastic can be interleaved to present a weather barrier when hung across a door opening that will part around a vehicle or other object or a person entering or leaving the doorway.

9 Claims, 4 Drawing Figures

INTERLEAVED FLEXIBLE WEATHER DOOR AND METHOD OF MANUFACTURE

BACKGROUND OF THE INVENTION

1. Field of the Invention

The present invention relates to weather barriers for doorways and particularly to such barriers made of strips of flexible plastic that will part around an object entering the doorway and close behind the object while admitting minimal airflow around the entering object.

2. Description of the Prior Art

Particularly with the increase in heating cost it has become common for commercial garages to use weather barriers that will separate around a vehicle entering the garage and close behind it without the necessity of opening a full door and closing it. Such weather barriers are commonly made of strips of plastic secured together along an edge from which they are hung. It has been known to make such weather barriers with two sheets of plastic sliced into strips at their lower ends and arranged so that the slit separations in one sheet are positioned over a center of a strip in the other sheet. Commonly the weather barriers are made in one layer of one sheet or of two or more layers each made with separate sheets of plastic. Sometimes each strip is made entirely separately.

SUMMARY OF THE INVENTION

Now in accordance with the present invention flexible weather barriers for doorways are made in horizontal sections in which each section is a multiple layer formed by folding of one or more plastic sheets. The plastic is slit vertically in a way that permits interleaving of the strips formed in the two layers. Thus it is an object of the invention to provide a flexible weather barrier for doorways in which each horizontal section of the weather barrier is fabricated from folded plastic sheets. Further objects and features of the invention will become apparent upon reading the following description together with the drawing.

DESCRIPTION OF THE PREFERRED EMBODIMENT

Figure 1:
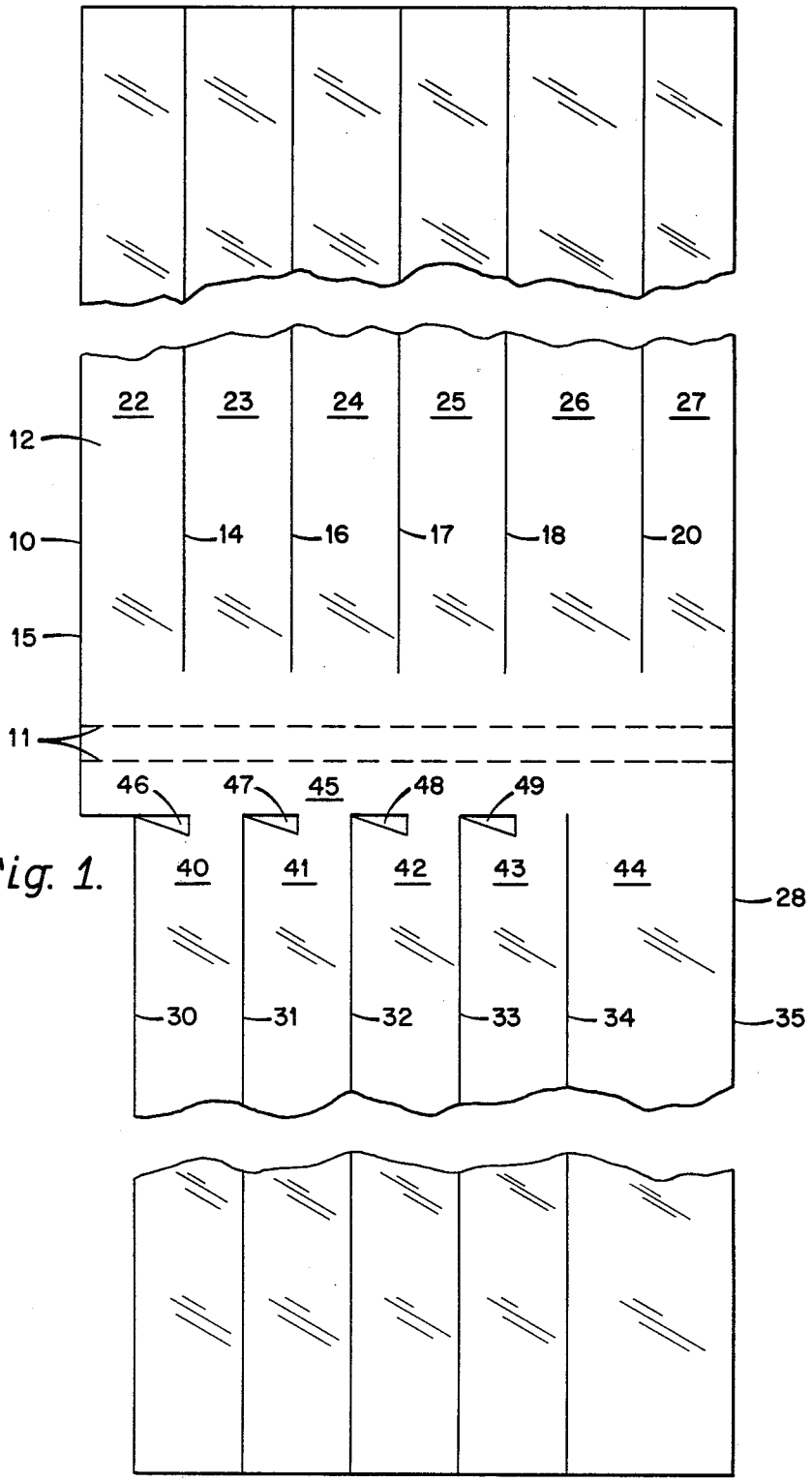
FIG. 1 is a plan view of a single horizontal section of a doorway weather barrier before the plastic sheet has been folded to form two layers.

The present invention provides a weather barrier that provides an improved weather seal and is more economic to fabricate using readily available sheet plastic material. Thus FIG. 1 shows a single horizontal section 10 of a doorway weather barrier which is suitably 54 inches wide and 20 feet long. It will be recognized that this is not as wide as will commonly be needed for a garage doorway but the width is picked as a readily available width in continuous flexible plastic sheeting as well as being a width that is not too difficult to handle in fabrication.

In a given installation more than one section will normally be overlapped to provide the complete weather barrier. The length of plastic sheet 10 will be determined in each case as at least twice the height of the opening to be covered. The example of a 20 foot length would be suitable for a 10 foot doorway opening. Different widths other than 54 inches can be used and 54 inches is only used by way of example. Likewise the particular slitting of the plastic sheet described has been found suitable for a 54 inch width but some variations are contemplated for fabrication convenience as well as other reasons in sheets of different widths.

Dashed lines 11 depict an area of sheet 10 at which the sheet would be folded to become a double layer. Sheet 10 is left solid for a short distance from fold area 11 and is slit on each end portion vertically 5 times. On first portion 12, the first 4 slits are evenly spaced, first slit 14 being 9 inches from first edge 15 and additional slits 16, 17 and 18 each being 9 inches apart. Fifth slit 20 in sheet portion 12 is spaced 11½ inches from slit 18 leaving 6½ inches to the edge of plastic sheet 10 and providing all together 6 strips of plastic 22, 23, 24, 25, 26 and 27. Second end portion 28 of sheet 10 on the other side of fold area 11 is similarly slit along its vertical length 5 times leaving a solid portion adjacent fold area 11.

First slit 30 is made 4½ inches in from edge 15. Succeeding slits 31, 32, 33 and 34 are each separated by 9 inches leaving a 13½ inch wide strip on edge 35. The first strip, 4½ inches wide, is not depicted since it has been found unnecessary and is preferable cut away. So, starting from edge 15, the strips in portion 28 are four 9 inch wide strips 40, 41, 42 and 43 and one 13½ inch strip 44. Starting from the side of each of strips 40, 41, 42 and 43 that is nearest edge 15, a triangular aperture is cut half way into the width of the respective strip. The triangles are right angle triangles which have their base along solid portion 45 of sheet 10 and their height extending in the vertical direction away from solid portion 45. The height of each triangle is suitable ½ inch and the base 4½ inches. The triangles are cut so as to leave flaps in strips 40, 41, 42 and 43 separated from solid portion 45. Sheet 10 is then folded along portion 11 so that first end portion 12 is brought down over portion 28.

Since the plastic sheets used tend to cling to each other, some type of antistick material should be used. Powdered material such as flour or talcum powder can be dusted onto one sheet. Also the plastic may be treated in manufacture of the plastic. Clinging is a problem only during fabrication since breezes blowing on the barrier normally overcome the problem in use.

Figure 3:
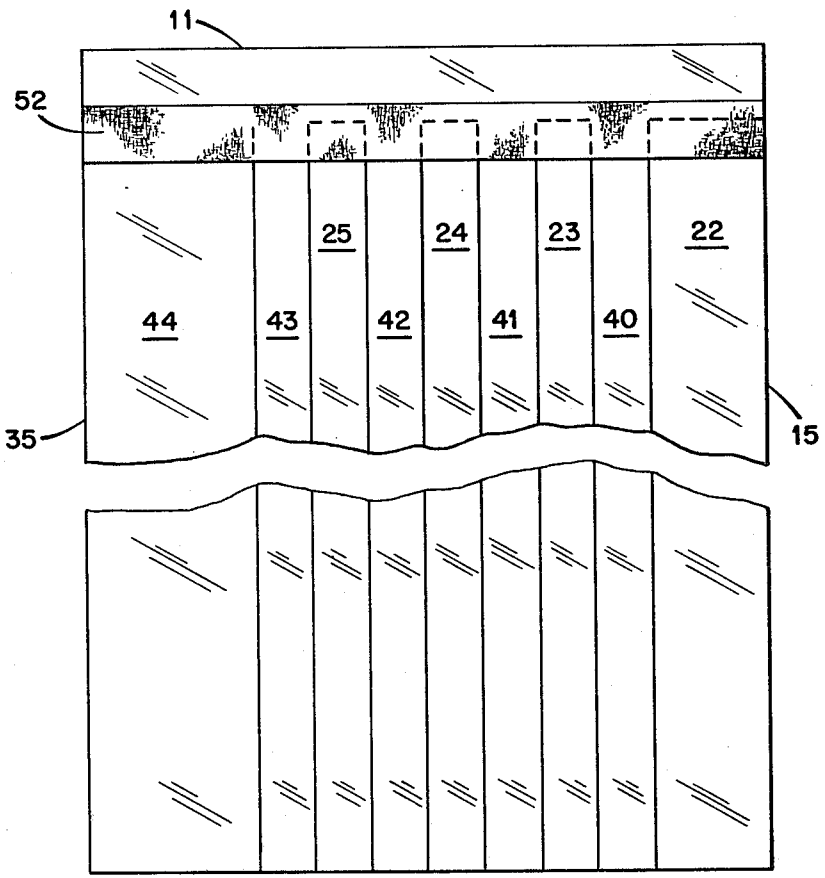
FIG. 3 is a rear elevation of FIG. 2.
Figure 2:
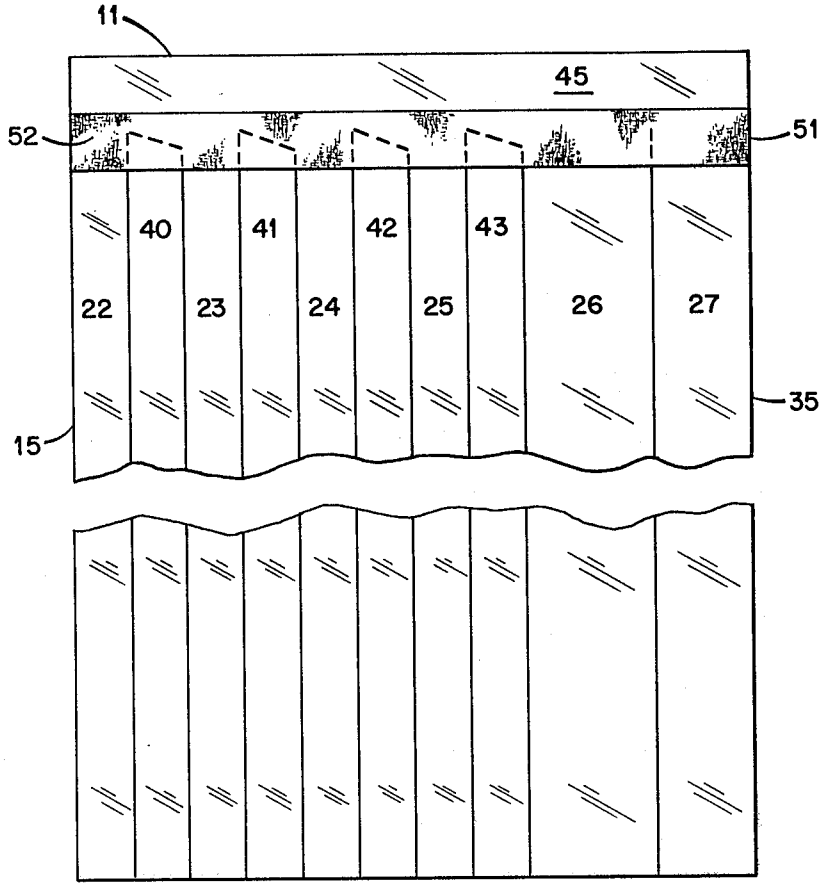
FIG. 2 is a front elevation of a first side of the horizontal section of FIG. 1 after folding.

As portion 12 is brought over on top of portion 28, the flaps of strips 40, 41, 42 and 43 left by the cutting of triangles 46, 47, 48 and 49 are bent up and then allowed to fall back on the other side of strips 22, 23, 24 and 25 respectively providing a partial interleaving of strips 22, 23 24 and 25 with strips 40, 41, 42 and 43, as depicted in FIGS. 2 and 3. FIG. 2 depicts the weather barrier section as it would appear in the view of FIG. 1 after folding side 12 over side 28. FIG. 3 then depicts the rear view of FIG. 2. In order to prevent the slits and the triangle apertures from causing tears in the plastic, portions 12 and 28 are desirably thermally bonded along horizontal zone 51 covering the triangular apertures and slit ends. Zone 51 is suitably one to five inches in width.

It has been found desirable to apply strips of strengthening tape 52 across zone 51. The strengthening strips can be either thermally or adhesively applied and preferably have a fabric base for strength.

In folding sheet 10, before providing the thermal bonding at zone 51, an open loop (see loop 55 in FIG. 4) may be provided along fold zone 11 for insertion of a support rod (not shown). It will be understood that in assembling a plurality of horizontal sections that the sections will be overlapped by approximately 4½ inches in the described embodiment prior to any thermal bonding. The thermal bonding then secures the horizontal sections together as well as strengthening the weak points of the slits and apertures.

While it is not critical which portion goes inside and which goes outside in overlapping two adjacent sections, suitably strip 22 of one section will go inside strips 27 and 44 of the next section. It will be recognized in connection with this overlapping that the reason for removing 4½ inch strip adjacent strip 40 is that this is an overlap area where an unnecessary amount of material is provided. A better balance of the material is arrived at by removing the mass of the one 4½ inch strip.

Figure 4:
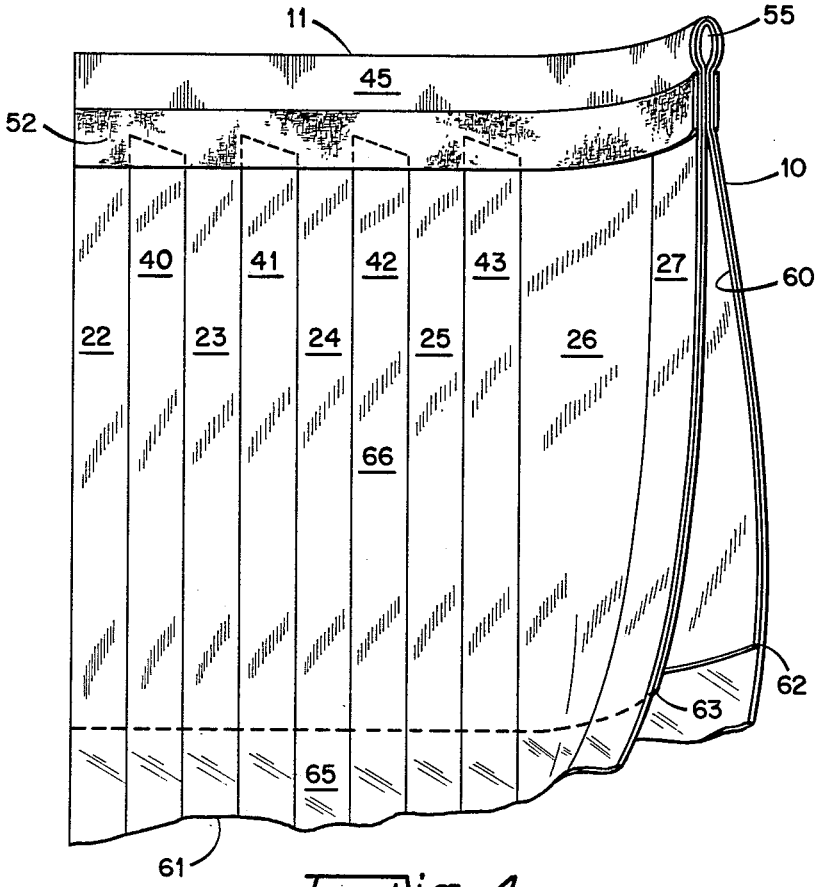
FIG. 4 is a front elevation with one edge turned in of a four-layer embodiment.

While each section of the barrier has been described as made from a single sheet of plastic, additional sheets can be used. In an automotive service station it has been found useful to use first sheet 10 of clear plastic and second sheet 60 of a shorter length in opaque, translucent or pigmented plastic. FIG. 4 shows an assembled section arbitrarily cut off at bottom 61 for ease of illustration. The usual length for the depicted width is too great for the drawing space available.

In fabrication sheet 10 is laid out with sheet 60 centered on top. The slits and aperture are made identically right through both. The sheets are folded together with sheet 60 inside sheet 10. The interlocking strips interlock in double layers with a double layer strip from one side interleaving with a double layer strip from the other. Sheet 60 terminates at ends 62 and 63. For a ten foot garage doorway, ends 62 and 63 may be 5 to 6 feet above the threshold. Lower section 65 (only partly shown) is thus only two layers thick and parts more easily for passage of an automobile. This is desirable to avoid scratches to the automobile finish. Upper portion 66 is four layers thick for better resistance to wind movement. By making sheet 60 opaque or translucent, sun glare can be reduced while allowing visibility through clear lower portion 65.

Where this is no passage of vehicles with highly finished surfaces, it is sometimes desirable to use two or more sheets, to provide a multiplicity of layers extending all the way to the threshold. Multiple layers in this manner have the means to provide a better barrier while retaining more flexibility than with a single sheet with the same mass.

The flexible plastic material for sheet 10 is suitably 12 to 20 mil thick polyvinylchloride plastic. The plastic is preferably treated to reduce deterioration from sunlight affects.

While the invention has been described with respect to a specific embodiment, it should be recognized that variations in the widths of the strips and the size of the triangles are contemplated and that the apertures do not have to have triangular shapes but may be simple slits, rectangular cut-outs or other shapes. The triangular cut-outs described have proven successful in allowing the material to interleave smoothly whereas simple slits tend to produce buckling of the material. It should also be recognized that the weather barrier sections can be fabricated of all identical strips all interlocking. This arrangement would have all strips interleaved but has not been found necessary.

Thus a number of variations obvious to those skilled in the art are contemplated and it is intended to cover the invention within the scope of the following claims.

We claim:

1. A flexible weather barrier for doorways comprising: a barrier section having (a) A flexible sheet of plastic folded in the middle, halfway of its length dimension, to form a double layer;

(b) a first plurality of slits in a first layer of said double layer extending from a first end edge inwardly to a first transverse region near said middle dividing said first layer into a first series of strips;

(c) a second plurality of slits in a second layer of said double layer extending from a second end edge inwardly to a second transverse region near said middle and opposite to said first transverse region to form a second series of strips, said second plurality of slits offset from said first plurality of slits whereby said slits do not fall on each other; and, (d) a plurality of apertures in said first layer, each aperture extending transversely from a respective one of said first plurality of slits at the end nearest said middle partially across the respective one of said first series of strips, said second series of strips passing partially through said apertures whereby said first series of strips and said second series of strips are interleaved with at least some of said strips being partly on one side and partly on the other side of said double layer.

2. A flexible weather barrier according to claim 1 wherein said barrier comprises a series of barrier sections overlapped end to end to cover the width of an entire doorway.

3. A flexible weather barrier according to claim 1 wherein said weather barrier further comprises an adherent horizontal reinforcing tape covering covering at least said transverse regions near said middle.

4. A flexible weather barrier according to claim 1 wherein said barrier section comprises multi layered plastic sheets all slit, folded and interleaved as though they were one.

5. A flexible weather barrier according to claim 4 wherein at least one of said multi layered sheets is shorter whereby the upper part of the weather barrier comprises more layers and is less affected by air currents while the lower part separates more readily for passage.

6. A flexible weather barrier according to claim 5 wherein at least one of said shorter sheets is pigmented while the longer ones are transparent.

7. A method of manufacturing a flexible weather barrier for doorways comprising:

(a) cutting a sheet of flexible plastic to a length at least twice the height of a doorway to be protected;

(b) slitting said sheet from each end into a plurality of strips with the slits extending to a midsection that is left integral, the slits from one end being offset with respect to the slits from the other end;

(c) cutting at least some of the strips in one end laterally a portion of their width at the location where they join said midsection;

(d) folding the sheet along the center of said midsection to form a double layer; and, (e) interleaving the laterally cut strips with strips in the other end so that portions of the interleaved strips are on each side of said double layer.

8. A method of manufacturing according to claim 7 further comprising overlapping a plurality of said sheets after said folding and interleaving so as to attain the width of a given doorway.

9. A method of manufacturing according to claim 7 further comprising bonding a reinforcing tape laterally across the location where the strips join said midsection.

* * * * *